US007226204B2

(12) United States Patent
Sevelle

(10) Patent No.: US 7,226,204 B2
(45) Date of Patent: Jun. 5, 2007

(54) BUTTER MAKER

(76) Inventor: Taja Sevelle, 21880 Independence Dr., Southfield, MI (US) 48076

( * ) Notice: Subject to any disclaimer, the term of this patent is extended or adjusted under 35 U.S.C. 154(b) by 190 days.

(21) Appl. No.: 11/054,967

(22) Filed: Feb. 9, 2005

(65) Prior Publication Data

US 2006/0176766 A1 Aug. 10, 2006

(51) Int. Cl.
*B01F 13/00* (2006.01)

(52) U.S. Cl. ..... 366/258; 366/332

(58) Field of Classification Search ..... 366/197–198, 366/204, 332, 255–260, 334; 99/348
See application file for complete search history.

(56) References Cited

U.S. PATENT DOCUMENTS

| | | | | | |
|---|---|---|---|---|---|
| 191,708 | A * | 6/1877 | Parrish | 366/332 |
| 258,658 | A * | 5/1882 | Leavitt | 366/258 |
| 291,901 | A * | 1/1884 | Henderson | 366/258 |
| 402,976 | A * | 5/1889 | Rudasill | 366/332 |
| 411,667 | A * | 9/1889 | Little | 366/332 |
| 511,056 | A * | 12/1893 | Nanny | 366/332 |
| 623,668 | A * | 4/1899 | Holt, Jr. | 366/252 |
| 813,497 | A * | 2/1906 | Hitchcock | 366/258 |
| 934,537 | A * | 9/1909 | Johnson | 366/332 |
| 949,864 | A * | 2/1910 | Treece | 366/332 |
| 1,175,366 | A * | 3/1916 | Lucas | 366/333 |
| 2,513,577 | A * | 7/1950 | Malme | 366/256 |
| 3,073,577 | A * | 1/1963 | Stevenson | 366/258 |
| 3,514,080 | A * | 5/1970 | Szilagyi et al. | 366/206 |
| 5,150,967 | A * | 9/1992 | Neilson et al. | 366/206 |
| 5,813,760 | A * | 9/1998 | Strong | 366/258 |
| 6,257,755 | B1 * | 7/2001 | Sevelle | 366/258 |
| 6,491,422 | B1 * | 12/2002 | Rutten et al. | 366/116 |
| 6,511,219 | B2 * | 1/2003 | Sevelle | 366/258 |
| 2006/0176766 | A1 * | 8/2006 | Sevelle | 366/197 |

FOREIGN PATENT DOCUMENTS

GB 2100613 A * 1/1983

* cited by examiner

*Primary Examiner*—Charles E. Cooley
(74) *Attorney, Agent, or Firm*—Greenberg Traurig, LLP

(57) ABSTRACT

A butter maker having a housing for mounting on a countertop in a kitchen or the like. The butter maker includes a cream holding container in which cream is placed and also includes drive assembly having a shaft both rotatable along its vertical axis and reciprocal therealong. The shaft includes a dasher having a pair of spaced paddles with a plurality of spaced throughholes extending into the container conforming generally to the inner configuration of the interior of the container but spaced from the inner wall thereof.

8 Claims, 10 Drawing Sheets

BUTTER MAKER

BACKGROUND OF THE INVENTION

1. Field of the Invention

The invention relates to butter makers; and, more particularly, a butter maker adapted to be set on top of a counter and activated to make butter and buttermilk.

2. Related Art

In my U.S. Pat. Nos. 6,511,219 and 6,257,755, I disclose a compact butter maker that can be used in a kitchen or the like. Butter is a common food fat product that has been used throughout the world for centuries as an ingredient of other foods or as a condiment. Today, butter is commonly made on an industrial scale with apparatus suitable for handling tens, hundreds, or more gallons of cream or milk. In a day before commercial creameries, butter was commonly made in the home using mechanical churns that, typically, were manually operated. As commercial creameries became prevalent, home butter making became less popular and advances in equipment for home butter making slowed. As a result, modem improvements in kitchen appliances have not been incorporated into home butter makers. Therefore, my patents fill a need for a butter maker that can be conveniently used in a contemporary home kitchen.

Thus, my butter maker in my patents used in the contemporary home kitchen. The butter maker therein is compact and fits on a counter or other surface in a home kitchen. The butter maker includes a cream container, a drive housing, a drive, and a dasher. The drive housing houses a drive, which is coupled to the dasher and adapted and configured to drive the dasher in reciprocal motion. The drive housing and the cream container are adapted and configured to reversibly mate and to position the dasher in the cream container for reciprocal motion within the container. The dasher and the container have complementary shapes with the dasher dimension to fit within the container and to define a space that can be occupied by cream within the container and around the dasher. Reciprocal motion of the dasher within the container converts the cream to butter.

I have determined that there is a need for a more substantial butter maker which is the type of appliance suitable for use in a kitchen.

SUMMARY OF THE INVENTION

It is an object of this invention to provide a butter maker adapted to be set on top of a counter and activated to make butter and buttermilk.

DESCRIPTION OF THE PREFERRED EMBODIMENT

Figure 1:
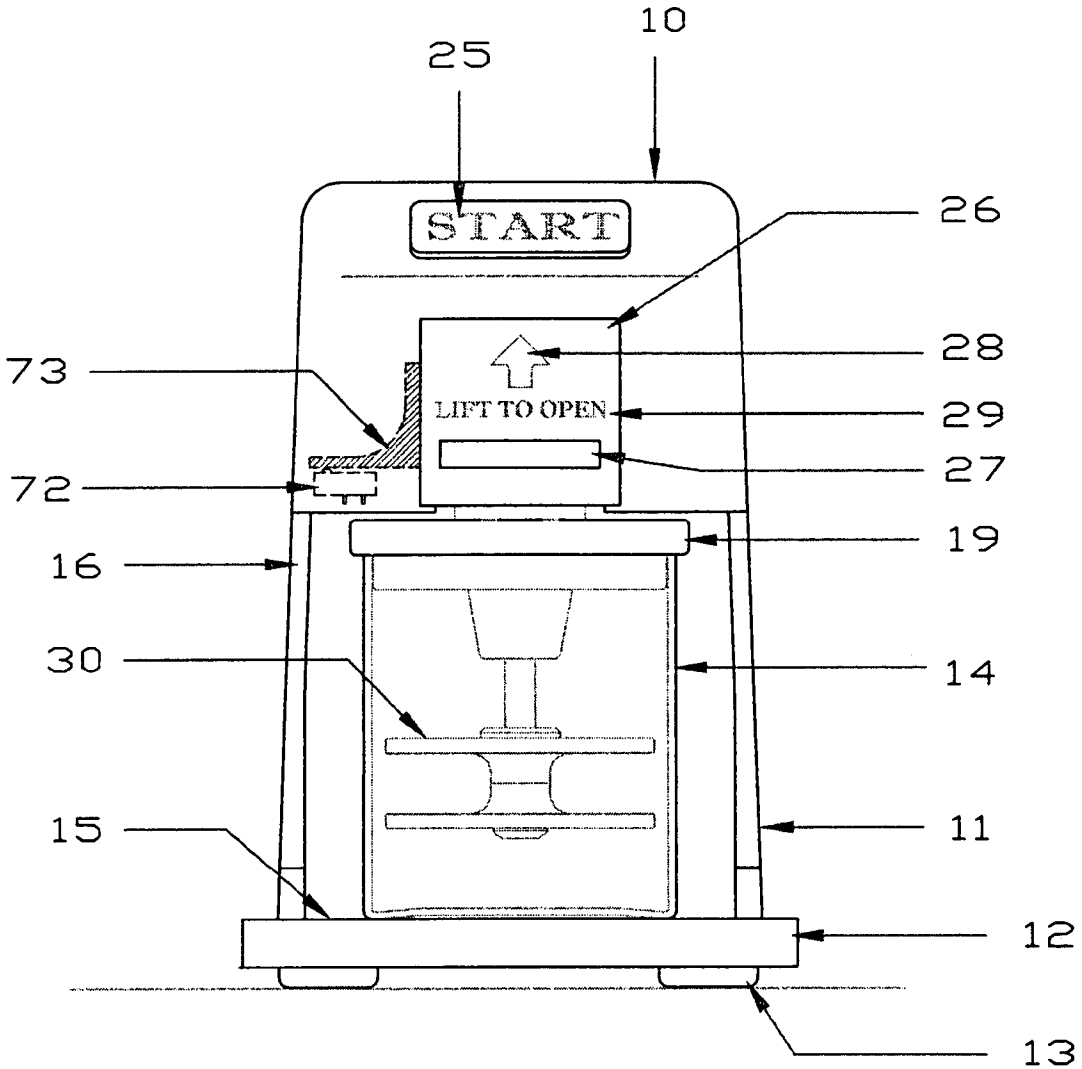
FIG. 1 is a front elevation view of a butter maker in accordance with the invention.

Referring now to FIG. 1 of the drawings, a butter maker 10 is shown comprising a main housing 11 extending upwardly from a base 12. A plurality, such as four, of resilient feet 13, one at each corner, may be provided on the undersurface of base 12. Butter maker 10 includes a cream container 14, which may be generally cylindrical and transparent and of glass or plastic or the like, normally disposed on the upper surface 15 of base 12 and open at the top (as will be discussed). The side walls 16, 17 (see also FIG. 2) of main housing 11 may be cut-out at a forward portion thereof, such as at cut-out area 18 (in each side wall 16, 17) to facilitate insertion and removal of container assembly 14 and allow access to jog switch 207.

Butter maker 10 includes a stepped container lid 19 which may be of a resilient material so that the container 14 press fits into an annular groove 20 (FIG. 3) in the lower wall 21 of upper stepped portion 22 of lid 19. As seen, the integral lower stepped portion 23 of lid 19 extends down into the open top of container 14. A resilient o-ring 24 may be provided in groove 20 to provide a liquid seal.

Figure 2:
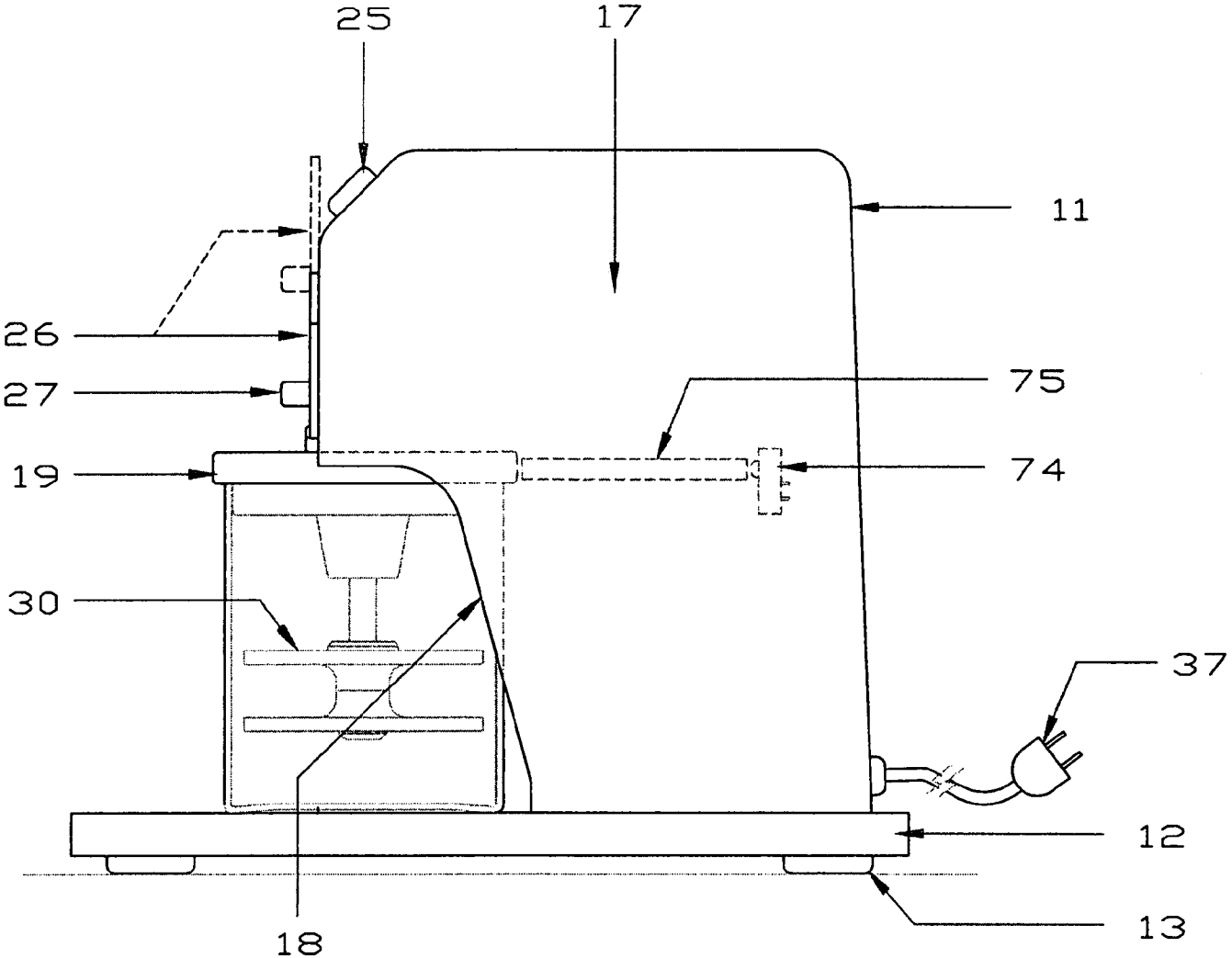
FIG. 2 is a right side view of the butter maker of FIG. 1, the left side view being a mirror image.

Referring again to FIG. 1, the upper portion of housing 11 may have a start button 25 at top and a movable panel 26 below button 25 having an elongated handle 27 (see also FIG. 2) for lifting panel 26 as will be discussed. FIG. 2 shows in dotted lines the movement of panel 26 from the lower to the upper position. Suitable indicia, such as a direction indicating arrow 28, may be provided on panel 26 along with other suitable operating indicia 29.

A beater assembly 30 is provided internally of butter maker 10 extending downwardly through lid 19.

Figure 3:
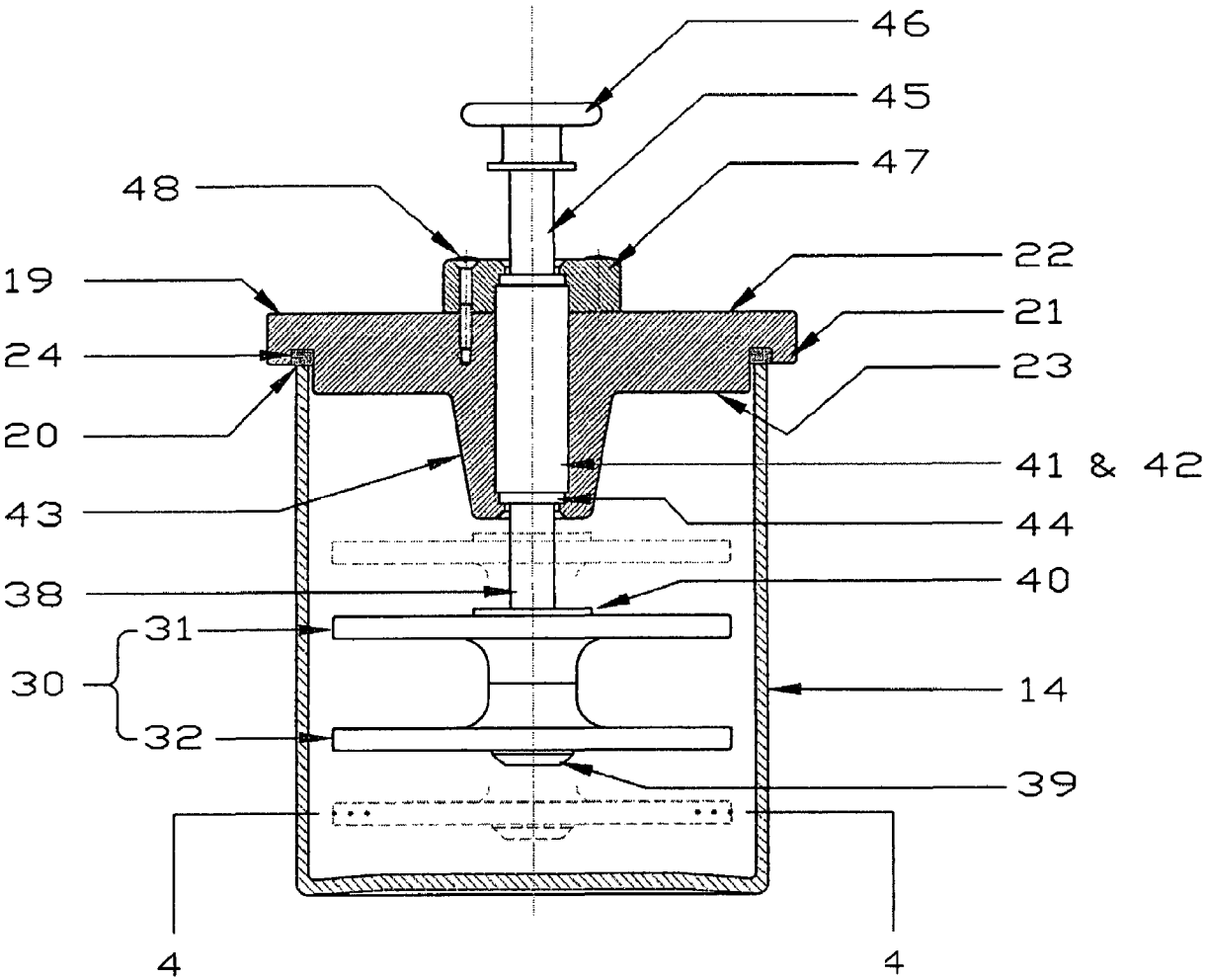
FIG. 3 is a sectional elevation view of the container assembly of the maker of FIGS. 1 and 2 removed from the housing.
Figure 5:
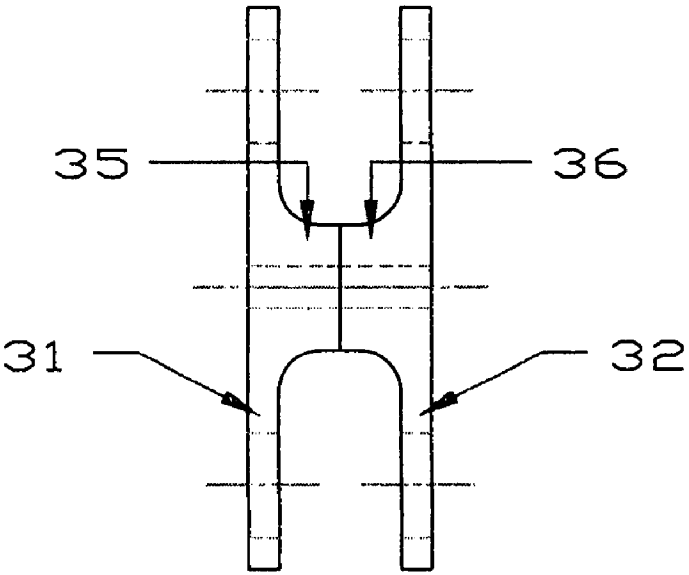
FIG. 5 is a side view of the beaters along of the assembly of FIG. 3.
Figure 4:
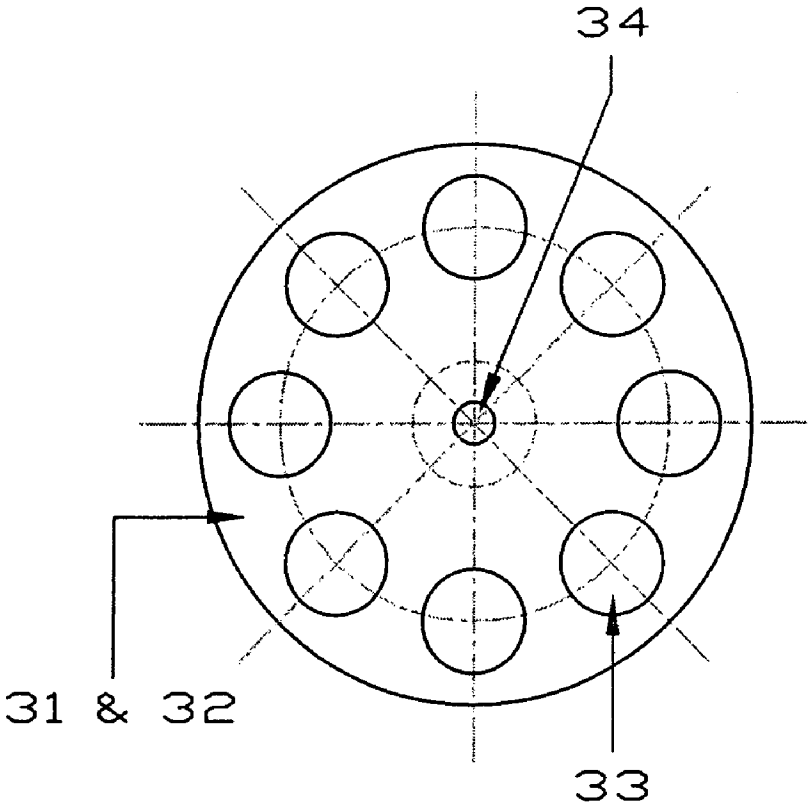
FIG. 4 is a view taken along lines 4—4 of FIG. 3.

Thus, as seen in FIG. 3, beater assembly 30 includes a pair of spaced paddles 31, 32. As seen in FIG. 4, each paddle, such as paddle 31, paddle 32 being identical, is generally circular, having a central aperture 34, with a plurality of round spaced holes 33 extending about aperture 32. Each paddle also has a centrally located hub portion 35 adapted to mate with a like hub portion 36 (FIG. 5) on a mating paddle 32 and sealed or otherwise secured together in a fluid tight manner.

As seen in FIG. 2, a suitable plug 37 is provided for plugging the butter maker 10 into a suitable electrical outlet (not shown).

Referring again to FIG. 3, the paddle 31, 32 are secured together by a shaft 38 extending down through the aligned holes 34 to a barrel nut 39. A resilient washer 40 may be provided through which shaft 38 extends. The shaft 38 may be threaded to thread into aligned holes 34, or holes 34 may be smooth bored with only the terminal end of the shaft 38 being threaded to thread to nut 39.

Shaft 38, at its upper end, extends through a bearing 41 mounted in a throughhole 42 extending through lid 19.

As seen, a centrally located integral hub portion 43 extends downwardly from stepped portion 23 of lid 19. A conventional shaft seal 44 may be provided at the area where shaft 38 enters bearing 41.

The upper end 45 of shaft 38 terminates in a beater drive assembly 46 as will be discussed. A closure member 47 is centrally mounted on lid 19 through which shaft 45 extends and is secured to lid 19 by a plurality of screws 48. The entire assembly shown in FIG. 3 is removable for ease of cleaning after the butter and buttermilk is removed.

The beater drive assembly 46 is coupled to a motor assembly 49 comprising a motor mount 50 coupled via screws 51 or the like to a mounting plate 52. Motor assembly 49 has a motor shaft 53 extending through an opening 54 in mounting plate 50 into driving engagement with a flywheel 55. A drive shaft 56 extends from flywheel 55 to a bearing 57A (FIG. 7) coupled to a second bearing 57'B and drive pin 58 via connecting link 59.

Figure 6:
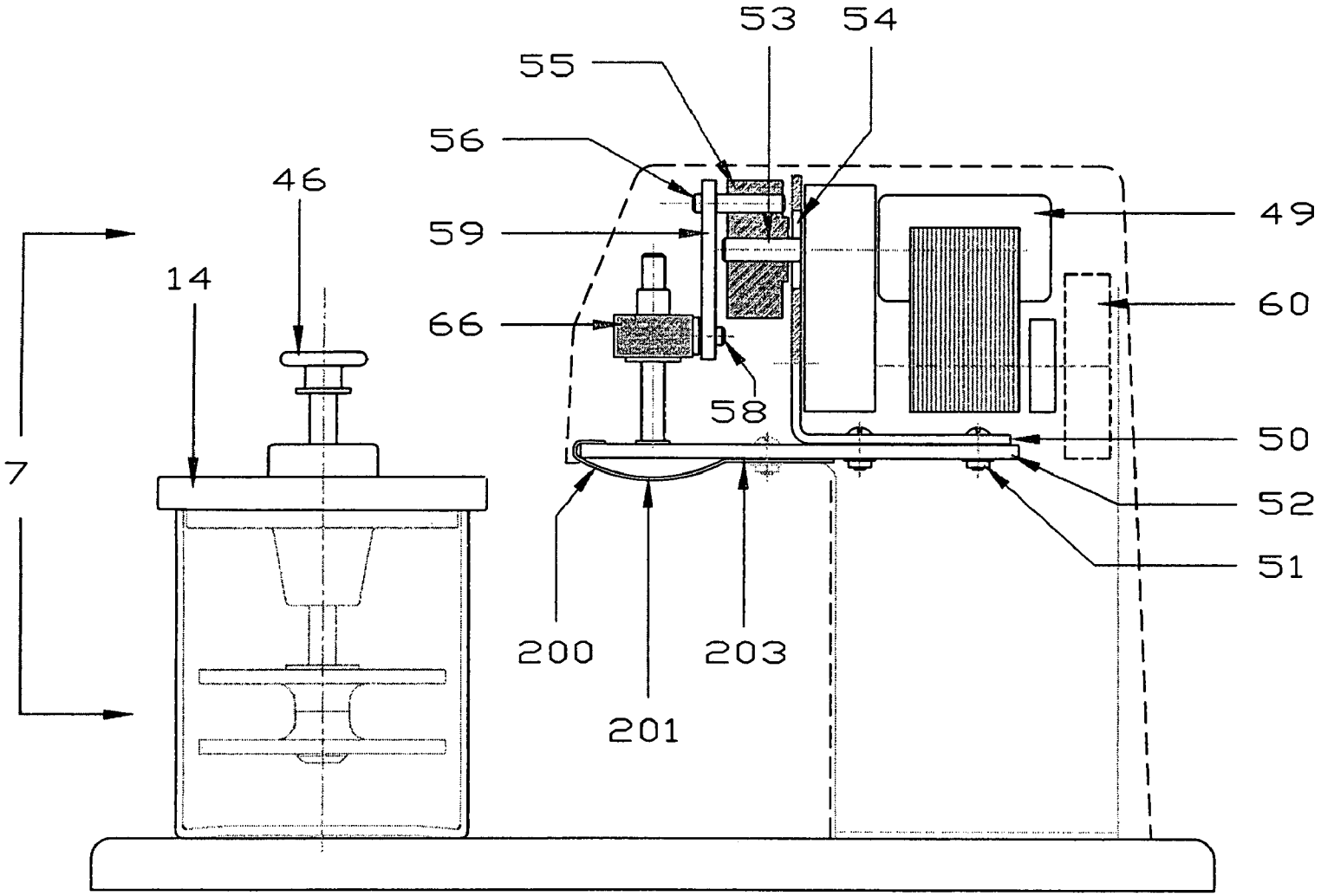
FIG. 6 is a side sectional view of the drive assembly alone of the butter maker of FIGS. 1 and 2 removed from the housing thereof.

A fan 60 (FIG. 6) may be mounted in housing 11 for cooling motor assembly 49.

Figure 7:
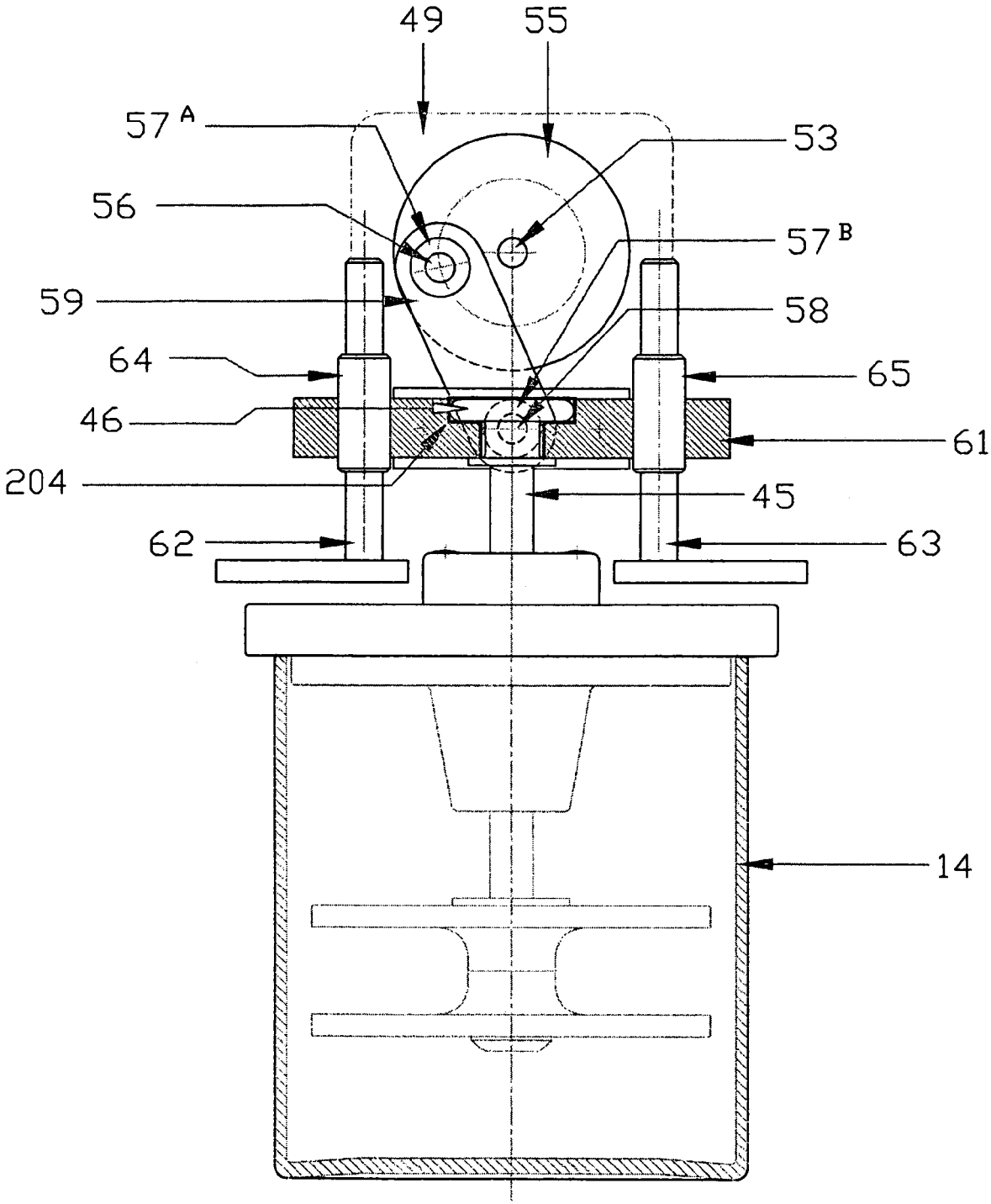
FIG. 7 is a view taken along lines 7—7 of FIG. 6.

The beater drive assembly 46 is seen more particularly in FIG. 7 and mounts into a T-shaped opening 204 in drive block 61 with shaft end 45 fixed thereto. Drive assembly 46 further includes a pair of spaced posts 62, 63 extending through openings in block 61. Bearing sleeves 64, 65 are associated with posts 62, 63, respectively.

It can be seen in FIG. 7 that actuation of motor assembly 49 rotates shaft 53 and flywheel 55. Drive shaft 56 on rotating flywheel 55 through connecting link 59 transfers its rotating movement, guided by posts 62 and 63 and bearing sleeves 64 and 65, into a vertical reciprocal movement of drive pin 58. Drive pin 58, being part of drive block 61, carries the beater drive assembly 46 when inserted.

Figure 8:
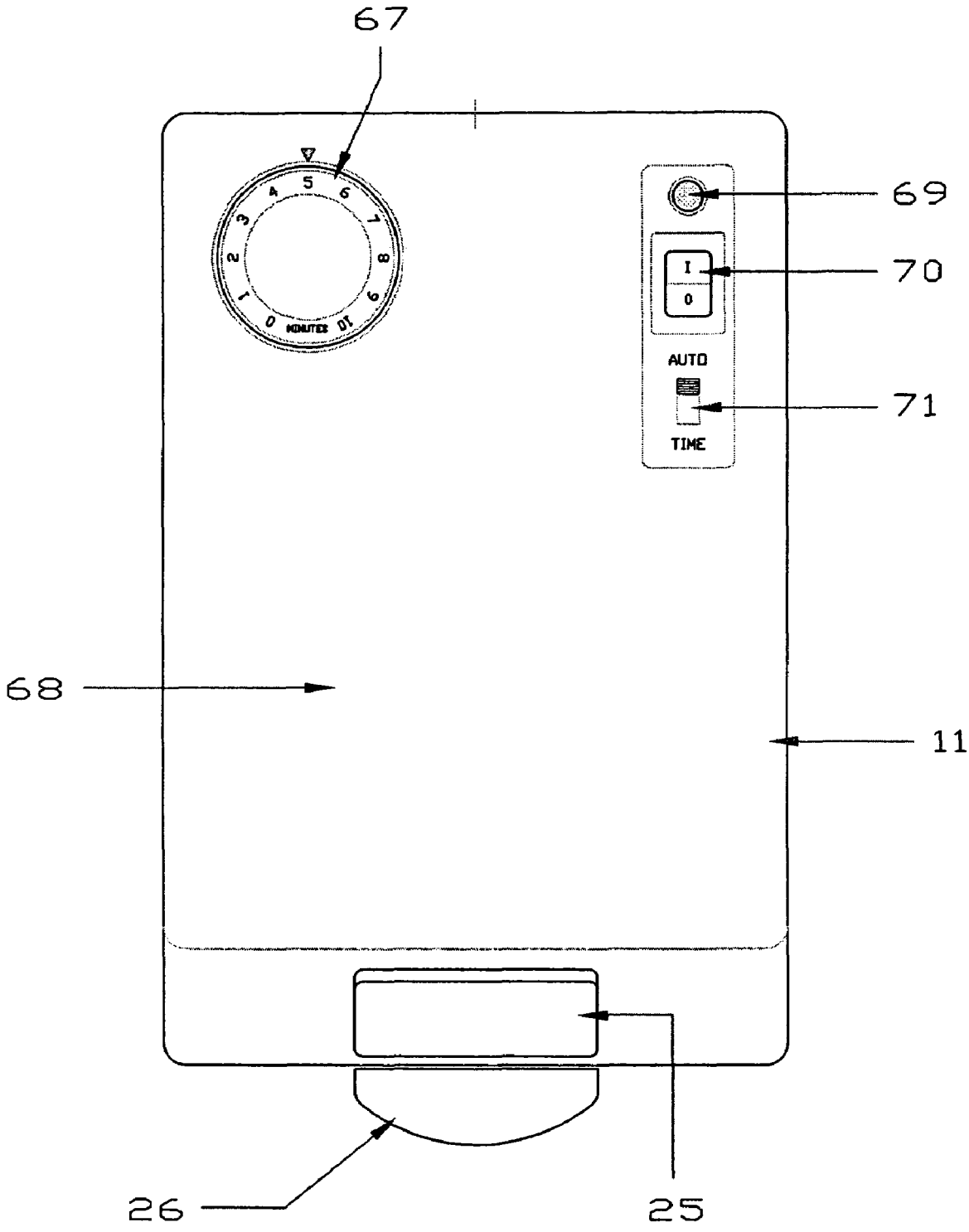
FIG. 8 is a top plan view of the butter maker of FIGS. 1 to 7.

As seen in FIG. 8, a suitable timer 67 may be provided on the upper wall 68 of housing 11 with suitable actuating means and switches, such as power "on" light 69, power switch 70 and an automatic or time control slide switch 71.

In operation, the user pours 1 pint of heavy whipping cream into container 14. Preferably, the cream should be at room temperature. The lid assembly, which includes the lid 19 and paddle assembly 30, is now inserted into the cream in container 14. The lid assembly fits automatically in place.

Switch 71 is set to either automatic or time and the start button 25 is pressed. If automatic, the butter will churn until done. If time controlled, the timer 67 may be set for any time between 0 and 30 minutes.

Inserting the container assembly 14 into the maker 10 automatically seals the container. Closing the door 26, and pressing the start button 25, starts the churning process. The churn process either stops automatically when butter is separated or runs for a predetermined length of time.

The user now removes the container and lifts the lid 19. The churned butter and buttermilk are placed in suitable containers.

Although the basic process for churning butter is disclosed, certain refinements can be made by the user. For example, ultra-heavy pasteurized whipping cream may be used. Various types of cream from different manufacturers may be used.

If the whipping cream is too cold, it does not separate or takes a long time. If the cream is too warm, it melts the butter and does not separate properly; the butter may get too creamy and mushy containing most of the buttermilk.

Preferably, the best cream temperature is about 55 to 65 degrees Fahrenheit. It should be removed from the refrigerator about 3–4 hours before processing.

Time setting: Depending on conditions and type of whipped cream the time for churning varies from 2–5 minutes. One should start with time setting of 5 minutes. If the butter separates in less time, the machine should be stopped by opening the access door. If more time is needed after the machine is stopped, the start switch should be pressed again. When the butter maker 10 is started in the "Auto" mode, the butter maker 10 runs until the churning process is completed (butter is done) and the motor is deenergized and stops. In the "Auto" mode, the churning process is controlled by the "Auto" control unit as seen in the wiring diagram of FIG. 9.

When the butter is done, the buttermilk separates and the butter solidifies. The motor may labor heavily and may stop under load. The access door should be opened and the container removed.

The cover should be removed along with accumulated butter from the container.

The butter may be collected into a shallow dish and, working with a spoon, compressed and drained to draw out all excess buttermilk.

The butter may be placed into a suitable container and keep cold in the refrigerator.

Briefly, the short operation is as follows:

| | | |
|---|---|---|
| Pour whipping cream in container. | | |
| Replace cover assembly. | | |
| Set timer to desired time in minutes. | | |
| Open access door and insert container. | | |
| Close access door. | | |
| Press start button. Churning will stop, when cycle completed. | | |
| Open access door, remove container. | | |
| Butter churn specification. | Power requirements: | 120 VAC 50/60 Hz 250 watts |
| | Dimensions: | 10" high × 7" wide × 11" deep |
| | Weight: | 16 lb. |

Container 14 may be of any suitable materials and dimensions, such as a 1½ pint mixing container of strong, clear acrylic material.

All container 14 components should be dishwasher safe. The butter maker assembly, (motor, etc.) stays clean during the churning process and is not submersible.

Any suitable motor dimensions and specifications may be used. For example, a 250 watt, 120 VAC 50/60 Hz motor may be used. The overall dimensions of maker 10 may be about 10" high, 7" wide, 11" deep and about 16 pounds in weight.

Figure 11:
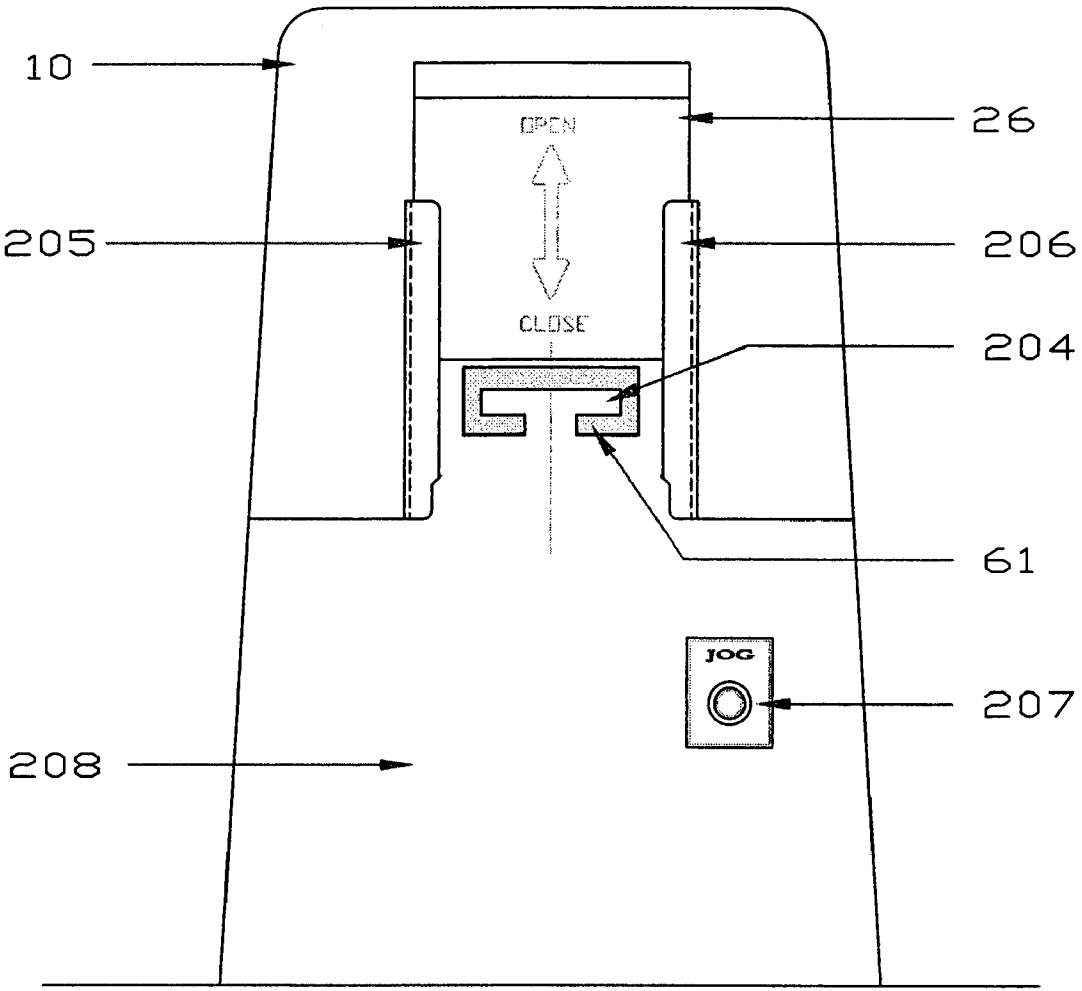
FIG. 11 is a front elevation view of the butter maker of FIG. 1.

FIG. 11 illustrates how the beater assembly 30 and container 14 is removed from butter maker 10. Access door 26 has indicia 28, as seen in FIG. 1, and the beater drive assembly 46 enters a T-shaped opening 204 in mounting block 61 (see also FIG. 7). Door or panel 26 may slide up and down between spaced side flanges 205, 206. A jog switch 207 is mounted on the front wall 208 of butter maker 10. Mixing container 14 and beater assembly 30 can not be removed or inserted unless the access door 26 is fully open and the mounting block 61 is properly aligned and visible in the access door opening. If one does not see the mounting block 61 in the door opening, as shown, a light touch of the "jog" switch 207 on the front wall 208 will move it to the desired position.

Thus, the door opening is rather small so that people will not insert fingers in it. Unless the container 14 is properly aligned, the container 14 can no be removed or inserted, the door 20 itself is in the way.

Opening the door 26 disconnects the electric power and thus the motor except for the jog switch 207, becomes inoperative.

The door safety disconnect switch 72 is shown in FIG. 1. A finger 73 extending from door panel 26 activates the switch 72 when door 26 is closed.

Just behind the container 14 is the container switch 74. This is a normally open wherein inserting the container 14 pushes the plunger 75 and activates the switch 74. The maker 10 can not be run without container 14 inserted.

Figure 9:
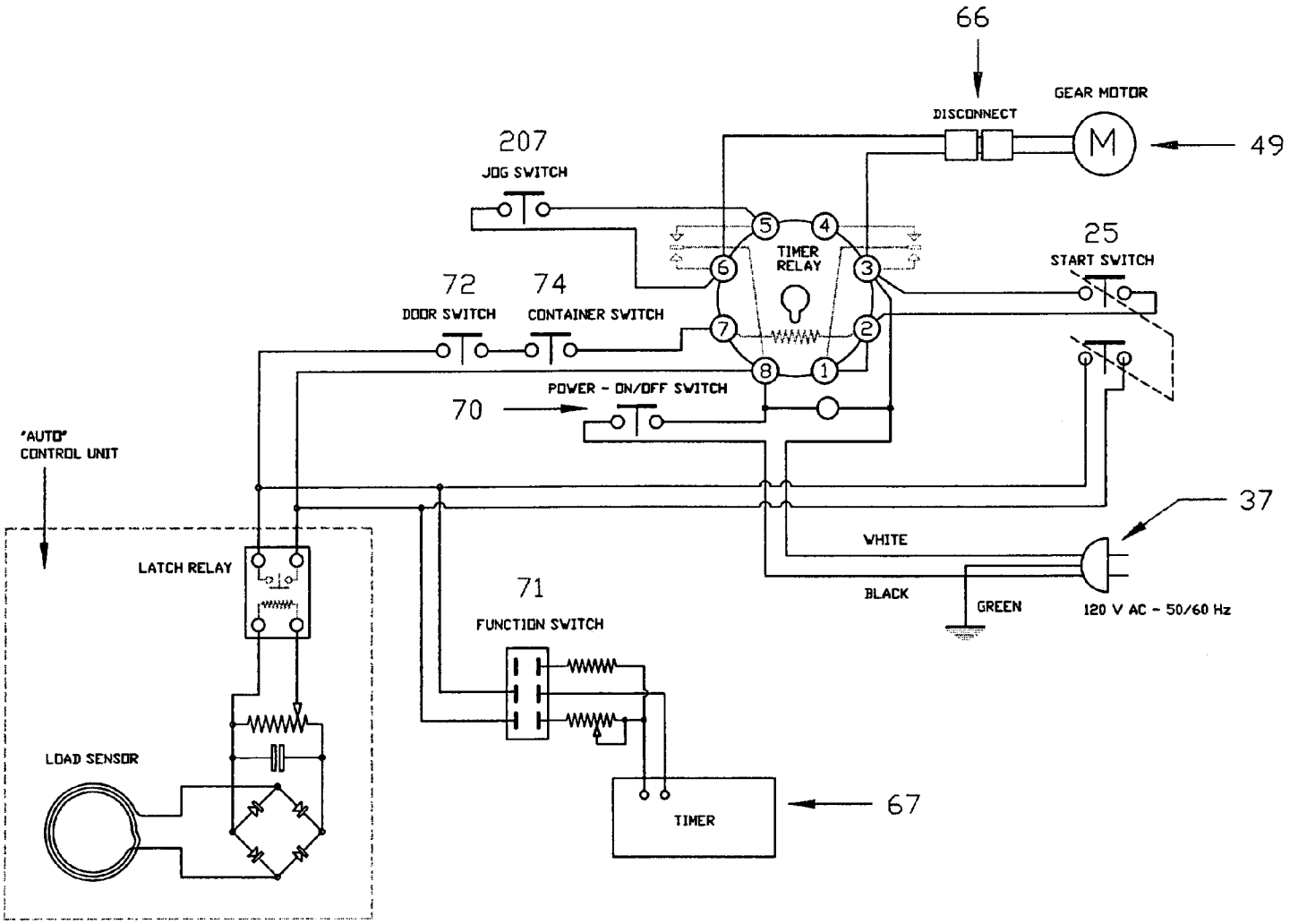
FIG. 9 is a schematic view of a circuit a circuit diagram that may be used in the device of the invention.

Any suitable electronic means may be used to carry out the invention. For example, a schematic illustration of a circuit that may be used is shown in FIG. 9 wherein like numerals refer to like parts of FIGS. 1–8.

Receptacle container 14 may be 4½" in height, 4" in diameter with a ⅛" wall thickness. Paddles 31, 32 may be about 3.375" in diameter so a spacing of about 0.375" is provided between the outer periphery of the paddles and the inner wall of container 14.

Figure 10A:
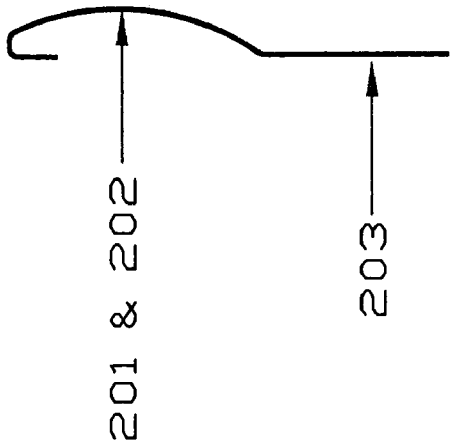
FIG. 10A is a side view of the part shown in FIG. 10.
Figure 10:
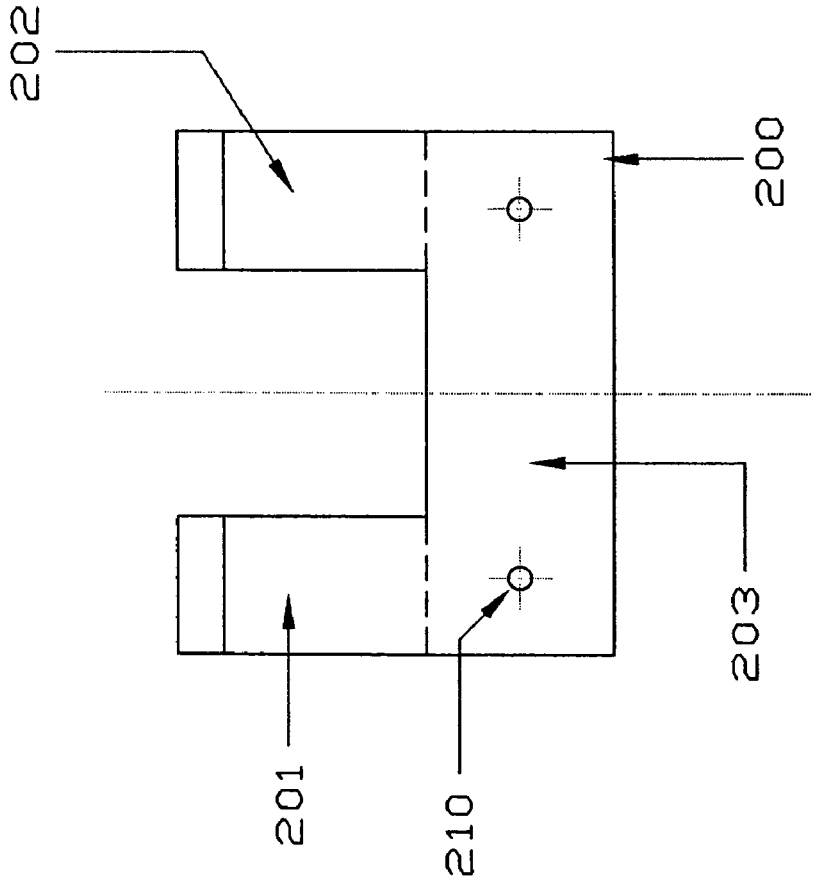
FIG. 10 is a top plan view of one of the parts of the butter maker of FIG. 1 removed therefrom for convenience of illustration.

In order to seal the container 14 and hold it firmly in place, a tension spring 200 (FIG. 6—see also FIG. 10) may be provided mounted to mounting plate 52 and having a pair of spaced forward hooked or curved portions 201, 202 (see FIGS. 10 and 10A) extending from flat portion 203. Thus, the lip of container 14 abuts there against and is held firmly in position. It applies pressure, seals the container 14 in position and holds it in place until removed. Spring 200 may be of any suitable material, such as phosphor bronze. Mounting holes 210 are provided for secured spring 200 to plate 52.

In conclusion, the maker 10 includes a container 14 with a separate cover assembly. The container 14 may be conventional kitchen type-type Pyrex Glass container that is dish washer safe. The cover assembly includes container lid 22, beater paddle assembly 30 and driver rod 45 are assembled into one unit. This unit can not be home disassembled and is dish washer safe. Container lid 22 has an O-ring style seal 24 on its underside matching the upper rim of the class container 14.

Both the glass container 14 and the cover assembly are individual parts and have no interlocking features and, unless inserted into maker 10, are always free to separate.

Sliding container 14 into the maker activates the tension spring parts 201, 202 located on each side underneath the maker 10 and seals the container 14 and holds it in place. In order to remove container 14, one opens the door 26 and slides the container 14 out.

Although a particular embodiment of the invention is disclosed, variations thereof may occur to an artisan and the scope of the invention should only be limited by the scope of the appended claims.

I claim:

1. A butter maker adapted to be mounted on a countertop in a kitchen or the like comprising:

a housing;

a drive assembly mounted in the housing;

a cream holding container removable attached to said drive assembly; and a dasher assembly including a dasher having an elongated shaft coupled to said drive assembly for reciprocating said shaft in an up and down direction along its vertical axis; and said dasher including a paddle assembly having said shaft fixed to generally the center thereof and having an outer peripheral configuration generally related to the inner configuration of said container and of an outer diameter slightly less than the inner diameter of said container, said paddle assembly comprising a plurality of spaced throughholes extending about said shaft, said throughholes having central axes generally parallel to the central axis of said shaft, said housing including a front wall, said front wall having an opening therein, said drive assembly adapted to be coupled to a drive at the upper end of said shaft remote from said dasher and being receivable in an opening in a drive block mounted internally of said housing, said drive assembly including a motor having a rotatable shaft adapted to interconnect with said drive when said drive is inserted into said opening in said drive block.

2. The butter maker of claim 1 wherein at least 8 throughholes extend about said paddle assembly.

3. The buffer maker of claim 1 wherein said paddle assembly includes pair of interconnector paddles, each of said paddles having said throughholes therethrough and each of said paddles having a hub portion fixedly secured to the hub portion of the other of said paddles forming a spacing between the paddles.

4. The maker of claim 1 wherein said opening in said front wall is normally closed by a door slidable between a first position allowing access to said drive to a second position closing off said opening in said housing.

5. The maker of claim 4 wherein said container is accessible through said door, and motor operating prevention means associated with said motor for preventing operation of said motor unless the container is properly positioned in the maker and the door is fully closed.

6. The maker of claim 5 including jogging means associated with said motor for jogging said container into a predetermined position in said maker allowing operation of said motor.

7. The maker of claim 6 wherein said container includes a peripheral lip and including a tension spring mounted in said housing having a resilient portion overlying said lip abutting against said lip retaining said container in position under tension when inserted into said housing.

8. The maker of claim 7 wherein said tension spring is generally U-shaped includes a flat portion fixed to said housing having a pair of integral spaced curved portions extending away from said flat portion to a position overlying said led when said container is inserted into said housing.

* * * * *